United States Patent [19]

Hemsath

[11] Patent Number: 5,020,596

[45] Date of Patent: Jun. 4, 1991

[54] ENHANCED OIL RECOVERY SYSTEM WITH A RADIANT TUBE HEATER

[75] Inventor: Klaus H. Hemsath, Toledo, Ohio

[73] Assignee: Indugas, Inc., Toledo, Ohio

[21] Appl. No.: 469,173

[22] Filed: Jan. 24, 1990

[51] Int. Cl.[5] ..... E21B 43/24

[52] U.S. Cl. ..... 166/272; 166/261; 166/303

[58] Field of Search ..... 166/261, 272, 302, 303

[56] References Cited

U.S. PATENT DOCUMENTS

| | | | |
|---|---|---|---|
| 3,614,986 | 10/1971 | Gill | 166/303 |
| 3,946,719 | 3/1976 | Bark et al. | 126/91 |
| 4,127,169 | 11/1978 | Tubin et al. | 166/303 X |
| 4,157,847 | 6/1979 | Williams et al. | 299/6 |
| 4,322,603 | 3/1982 | Bright | 166/272 X |
| 4,336,839 | 6/1982 | Wagner et al. | 166/303 X |
| 4,378,846 | 4/1983 | Brock | 166/303 |
| 4,397,356 | 8/1983 | Retallick | 166/303 |
| 4,442,898 | 4/1984 | Wyatt | 166/303 |
| 4,463,803 | 8/1984 | Wyatt | 166/303 X |
| 4,678,039 | 7/1987 | Rivas et al. | 166/302 X |
| 4,694,907 | 9/1987 | Stahl et al. | 166/303 |

FOREIGN PATENT DOCUMENTS

| | | | |
|---|---|---|---|
| 1197457 | 12/1985 | Canada | 166/39 |

OTHER PUBLICATIONS

"Fundamentals of Enhanced Oil Recovery", by H. K. van Poollen and Associates, Inc., 1980, PennWell Books, *Executive Summary,* pp. X–XVI.

*Primary Examiner*—Ramon S. Britts
*Assistant Examiner*—Roger J. Schoeppel
*Attorney, Agent, or Firm*—Body, Vickers & Daniels

[57] ABSTRACT

An in situ thermal system is disclosed for enhanced oil recovery and the like from a subterranean formation. The system pressurizes the formation with water whereupon the entire formation is heated to relatively high temperatures in the absence of gas formation to significantly decrease the viscosity of substantially all the crude in the formation and permit recovery thereof. A down hole, fuel fired radiant tube burner of long length is provided to achieve the desired heat patterns within the formation.

16 Claims, 4 Drawing Sheets

ENHANCED OIL RECOVERY SYSTEM WITH A RADIANT TUBE HEATER

This invention relates to a system for oil recovery from a reservoir formation and more particularly to a down hole, radiant tube heater apparatus, per se and in combination with the system.

The invention is particularly applicable to recovering oil from a previously drilled well and will be discussed with particular reference thereto. However, the invention has broader application and may be applied to the mining of any subterranean formation which can use heat within the formation to mine a substance from the formation. In addition, the heater apparatus will be discussed with reference to a down hole heater for the oil recovery system disclosed. However, the heater has broader application and is specifically applicable to industrial heating, heat treating applications and any applications involving high temperature heat transfer.

INCORPORATION BY REFERENCE

The following documents are incorporated herein by reference and made a part and parcel hereof for background purposes and as assistance in the description of conventional methods and hardware used in the practice of the present invention:

1. H. K. van Poolen et al, *Fundamentals of Enhanced Oil Recovery,* Pennwell Books, 1980, Tulsa, OK. "Executive Summary" at pages X–XVI;
2. Stahl U.S. Pat. No. 4,694,907 and Shu Canadian Patent 1,197,457;
3. Gil U.S. Pat. No. 3,614,986 and Williams U.S. Pat. No. 4,157,847; and
4. Bark U.S. Pat. No. 3,946,719.

BACKGROUND

A) SYSTEM CONCEPTS

It is estimated that the depleted oil reservoirs still contain well in excess of fifty percent (50%) of the original oil. The reference work, *Fundamentals of Enhanced Oil Recovery,* defines three different types of processes which enhance oil recovery from subterranean reservoir formations. The processes are classified as thermal processes, chemical processes and miscible displacement processes. This invention relates to a thermal process.

There are three types of thermal processes which have been commercially practiced in the recovery of oil from a reservoir formation. The first method is defined as steam stimulation which is also known as cyclic steam injection, steam soak or huff-n-puff. In this method, steam is injected into a producing well for about two to three weeks. Following this, the well is "shut in" for several days and then placed in production. The second process is the steam flooding process in which steam is injected into a number of injection wells while the oil is recovered from adjacent production wells. The last method is the "in situ" combustion method in which the oil reservoir is ignited through an injection well and continued injection of combustion air through the injection well drives the flame front propagation away from the injection well towards the production well. The propagation of the flame front can be somewhat controlled by the position of the injection well and then shifting the injection of combustion air from one injection well to another, etc.

All of these processes depend on or are based on the well-known fact that any heating of the oil remaining inside a reservoir decreases its viscosity and improves mobility of the oil. With increased mobility, additional oil recovery is possible. However, the commercial processes described, while highly practiced, have inherent defects which prevent full recovery or substantial recovery of the oil in the reservoir. In the steam stimulation method, the initial success of the method is quite good. However, only a relative small volume of the oil around the injection point will be drained from the reservoir. The rest of the reservoir is not affected and productivity decreases rapidly after the second or third injection try which is completely understandable from the way that heat is being applied to the reservoir.

In particular, when the steam penetrates the reservoir, it follows the path of least resistance and once the oil in this path is removed, subsequent injections simply follow the paths established in the initial injection. This channelling is commonly known as fingering and limits the effectiveness of the steam stimulation method. The steam flooding or injection method is somewhat more effective in the use of heat. This results simply because more of the reservoir is exposed to the steam than that in the steam stimulation method and thus more fingers arise. Once the fingers are formed, continued injection of the steam recovers very little if any, additional oil from he reservoir. Both steam stimulation and steam flooding methods are limited to wells which are not significantly deep because hydrostatic pressure must be lower than the critical steam pressure at 3,208 psig. Even with shallow wells and the use of the steam flooding method, the steam condenses as it is piped down the injection casing and once it is physically within the reservoir, condensation continues. In the process of condensation, steam generates latent heat increasing the sensible heat of the surrounding water heating the reservoir and reducing the viscosity of the oil. Again, the large losses in the steam piping are an inherent limitation in the efficient use of the system heat which affects all steam processes. For purposes of this invention, it is noted that inherent in the steam flooding process is the fact that hot water will exist in the reservoir upstream of the steam front. That is, hot water is produced by the steam front as it condenses and this hot water will initially be at the condensation temperature of the steam but the hot water will cool below this temperature as it gives up its heat to the reservoir formation.

In the in situ combustion process, the heat produced during combustion leads to an increase in temperature in the vicinity of the combustion process and in the formation of gas as a result of the thermal decomposition of oil. The process results in sudden steep temperature rises which leads to the thermal breakdown of the oil and this, in turn, results in reduced recovery and retention of a major portion of the oil within the reservoir in the form of carbon or coke. Again, the process is not well suited for applications where fingering and preferred flow paths have been established within the reservoir during earlier production, i.e. steam flooding or steam stimulation.

Within the prior art literature, Stahl U.S. Pat. No. 4,694,907 shows the use of hot water pumped through an injection well and then heated by an electrical down hole heater to produce steam for steam flooding. An orifice in the electrical down hole heater is said to compensate for the hydrostatic pressure developed in the hot water head so that steam can be formed in deep wells. Stahl uses an electrical down hole heater to generate steam and is cited to show conventional, electrically powered heaters.

Shu Canadian Patent 1,197,457 illustrates a process in which steam is initially injected through an injection well which is shut in until the pressure at the production well has dropped to a predetermined value. Hot water or low quality steam is then flooded into the oil reservoir and the production from the reservoir continues. Shu is believed pertinent because he shows that the adverse effects limiting production from the reservoir attributed to steam formed channels or fingers can be somewhat overcome by the use of hot water or low quality steam. However, Shu's process is obviously limited because the water or low quality steam injected into the well can only be heated to a relatively low fixed temperature, heat losses occur in transmission down the casing and the low temperature of the water in the reservoir cannot significantly heat the reservoir formation. Thus, the Shu process in the first instance is limited to shallow wells whereat steam can be initially formed and in the second instance is significantly limited in the sense that only a limited amount of heat can be inputted to the reservoir formation and this limits the oil recovery. In addition, Shu equates or teaches that low quality steam, a medium which can be compressed, can be interchanged with hot water, which is incompressible.

In a somewhat unrelated area, it is known to mine sulphur after salt has been removed from capped rock formations by means of the Frasch process. This process consists of heating water under pressure external to the formation to a temperature of about 325° F. and then injecting the water into the capped rock of the dome. The super heated water flows out into the sulphur bearing deposit and when the temperature of the sulphur bearing formation reaches or exceeds the melting point of the sulphur, liquid sulphur flows to the bottom of the well whereat a differential pressure arrangement is used to carry off the molten sulphur. In Williams U.S. Pat. No. 4,157,847, a process is disclosed where additional water or steam is added to the water previously injected into the reservoir by means of an underground jet pump to improve the heat transfer capabilities of the "spent" previously heated water present in the formation. In Gil U.S. Pat. No. 3,614,986, a down hole electric heater is used for sulphur mining by the Frasch process at depths in excess of 2,000 feet. Gil's down hole heater heats the hot water back to its original surface temperature to compensate for the casing heat loss as the water travels from the surface to the sulphur bearing deposit. The basic concept is to use hot water heated at the surface and injected into the sulphur formation to liquify that portion of the sulphur which can be heated by the hot water before the hot water's heat is dissipated. The improvements relate to adding heat to the hot water previously injected into the formation. There is no heating of the formation.

B) HEATING APPARATUS

Because of the small sizing of the casing or bore diameter of the injection and production wells, down hole heaters, if used, have heretofore relied on electrical heating elements inserted into the casing. Whether the heating elements be resistance heating elements or induction heating elements, the power generating equipment must be capable of generating high heat fluxes. The space limitations within the casing make it difficult to position and size electrical heating elements which can generate high heat flux uniformly along the casing lengths. In fact, the heating elements gradually heat the steam or water travelling along the length of the elements to higher and higher temperatures until steam is formed at the discharge point. Thus, down hole heaters use excessive amounts of electricity to generate high heating fluxes in applications where heating progresses to the highest temperature coincident with the discharge point of the steam from the heater.

Fuel fired burners are, from an energy cost analysis, less expensive than electrical heating arrangements. However, the size of the well casing coupled with the requirement that hot water or steam be generated or boosted at the bottom of the casing while the steam or water flows therethrough has heretofore precluded their application as heaters for recovering materials from subterranean formations.

In an unrelated application, radiant tube burners or heaters have long been used in industrial heating applications and have conventionally been powered by electrical heating elements or by fuel fired burners. Electrically heated radiant tubes basically comprise heating elements within a tube which extend into a furnace or work zone. The elements radiate heat to the tube and the tube radiates heat to the work. In high temperature heating applications such as those involving the melting of metals and the like, electrically heated radiant tubes are preferred since the heating elements radiate uniform heat flux to the tube. Again, the cost of electricity in a high temperature flux application dictates that fuel fired burners be used to fire their products of combustion into a tube which in turn will radiate heat to the work. However, fuel fired radiant tube heating applications do not maintain a uniform temperature along the length of the tube especially at high temperatures where radiated heat fluxes are especially significant when considering heat transfers from burner to work. In such application, the adiabatic temperatures produced by the fuel fired burner cause a hot spot whereat the heat flux intensity is greater than that at other areas of the burner. Numerous schemes have been tried to arrive at uniform distribution heat patterns, especially at high temperatures from fuel fired burners. These have met with varying degrees of success. One such arrangement, funded by Gas Research Institute, uses a tangentially fired burner with products of combustion from the burner entering a slotted baffle arrangement to develop high convective heat transfers in the form of slotted jets. Convective heat transfer from the slotted jet is then used as a "boost" to the radiated heat flux from the tangential burners to heat a mantle to very high temperatures of 2500° F. However, the heat transfer coefficient while enhanced with this arrangement is fundamentally limited by the coefficient attributed to the radiation heat transfer of the tangentially fired burner which is poor.

Also, within the industrial burner art there are numerous fuel fired burner arrangements which, at first glance, might bear some structural resemblance to the fuel fired radiant tube heater of the present invention, but which have entirely different functions and purposes associated with the structure. For example, Bark U.S. Pat. No. 3,946,719 discloses a burner with longitudinally spaced apertures designed to receive combustion air for cooling certain burner parts to prevent thermal breakdown of the burner.

SUMMARY OF THE INVENTION

Accordingly, it is one of the principal objects of the present invention to provide an enhanced system for recovering oil and the like from subterranean formations by means of an especially developed heat transfer concept which uses a down hole heater.

This object along with other objects and features of the invention is achieved in a method, system and/or apparatus which may be defined as an in situ arrangement for recovering oil from a subterranean reservoir formation which has a conventional production well bore and a conventional injection well bore extending into the reservoir formation. The reservoir is initially filled with water such that a predetermined pressure exists in the reservoir formation. Preferably, this predetermined pressure will inherently arise as the result of the hydrostatic pressure when the system is applied to deep wells. Alternatively, the water may be pressurized for shallow wells by external means such as pumps. The down hole, radiant tube type heater which has been inserted into the injection bore to a position adjacent and within the reservoir formation is then ignited. The heater heats the reservoir formation including the water and heating of the reservoir formation is enhanced by thermal conductivity of heat flux from the heater through the water to the formation. Heating of the entire reservoir formation continues over a period of time (expressed in terms of months) until the viscosity of the oil within the formation is reduced to a value whereat the oil moves freely with the water at which time the production well is actuated to recover the oil.

In accordance with another specific feature of the invention, the pressure of the water and the temperature at which the reservoir formation including the water is heated are variables but are correlated to one another in the sense that the heater is controlled to avoid heating the water to a temperature whereat, for the pressure exerted on the water, steam will be produced or the oil in the formation will decompose so that only sensible and not latent heat will be utilized in the process. At the same time, the pressure of the water at a minimum value must be sufficient to force the water to fill or plug the fingers previously formed in the formation by steam stimulation or steam flooding methods. More specifically for shallow wells where the hydrostatic pressure is sufficient to plug the fingers, heating is controlled so that no gas is produced either in the water or in the oil formation. For deep wells where the hydrostatic pressure is sufficient to exceed the steam critical point or for shallow wells where the water is pressurized beyond the steam critical point, the formation is heated at temperatures which will not produce gas from the oil.

In accordance with another system feature of the invention, the process and apparatus are ideally suited to a reservoir formation where a number of production and injection wells have been drilled so that the entire reservoir formation can be heated by a plurality of wells selectively situated about chosen production wells such that any one injection well can provide heat input to a plurality of production wells adjacent to the injection well.

In accordance with yet another specific feature of the invention, the down hole heaters are of long length and sized relative to the depth of the formation and radiate heat uniformly along its length to develop preferred isothermal patterns throughout the reservoir which enhance the heating of the reservoir formation.

In accordance with a still further aspect of the invention, a control arrangement including temperature sensing mechanisms are provided at discrete locations within the reservoir formation including the water to control the heating of the formation in accordance with the parameters established above.

Yet other specific features of the invention include moving the water such as by establishing differential pressure between injection and production wells to enhance thermal conduction of the heat within the water and in turn produce more rapid heating of the oil formation prior to oil recovery.

A further optional feature of the system is to add chemicals to the water which are not adversely affected by the heat and which enhance the displacement of the oil from the reservoir.

In accordance with another aspect of the invention, a fuel fired radiant tube burner is provided which includes a generally cylindrical heat tube, a second cylindrical heat transfer tube concentrically disposed within the heat tube and defining a longitudinally-extending annular exhaust gas passageway therebetween and a third cylindrical burner tube concentrically disposed within the second tube and defining a longitudinally-extending annular heat distribution passageway therebetween. A burner within the burner tube ignites, combusts and burns a source of fuel and air to form heated products of combustion within the burner tube. All tubes are closed by a plate at one axial end thereof while a plate at the opposite axial end of the heat transfer tube and burner tube make heat distribution passageway a closed passageway. Apertures and openings are provided relative to the heat distribution passageway in a preferred orientation such that the heat tube is uniformly heated along its length by the heat transfer tube. More specifically, the apertures and openings are sized and positioned and the tube diameters selected to develop a substantially laminar flow of the products of combustion from the burner within the heat distribution passageway which modifies the radiation flux emanating from the burner such that the radiation heat flux transmitted from the heat transfer tube is effective to uniformly heat the heat tube along its length.

In accordance with a more specific feature of the invention, a plurality of apertures extend through the burner tube at spaced increments which spacing longitudinally decreases in the direction of the end plate which is spaced away from the burner. Similarly, the heat transfer tube has a plurality of spaced openings which likewise decrease in the longitudinal direction towards the end plate so that a greater mass of the products of combustion enter and exit the annular heat distribution passageway at positions closer to the end plate and spaced away from the burner. Importantly, the radial distance between the heat transfer tube and the heat tube is maintained at a very small distance and the circumferential and longitudinal distances between apertures and openings are spaced at relatively long distances relative to the size of the opening to establish relatively long flow paths for the products of combustion which flow at a Reynolds number sufficient to establish laminar flow conditions within the heat distribution passageways. The laminar flow conditions for closely spaced plates establish high convective heat transfer fluxes which modify the heat radiation flux emanating from the burner to balance the hot spots which would otherwise occur by radiation from the burner within the burner tube.

It is thus an object of the invention to provide an improved system and method for enhanced oil recovery from oil reservoir formations previously tapped by steam injection and/or steam flooding methods.

It is another object to the invention to provide an improved system and/or method for enhanced oil recovery from subterranean oil formations which may be characterized as tar sand formations and/or shale oil formations and/or whether or not such formations have been previously mined.

A broad object of the invention is to provide an improved system for recovering any material from a subterranean formation which can be liquified or made to flow in a liquified state by the application of heat.

It is still yet another object of the invention to provide an enhanced oil recovery system which provides any one of the following characteristics or any combination of the following characteristics:

a) more efficient use of heat than that now employed and in particular a system which specifically uses sensible as contrasted to latent heat;
b) a more economical system in the sense that the cost of the energy to develop the heat used in the oil recovery is less expensive than that now used;
c) an economical system or method of oil recovery in that the energy or btu recovered in a barrel of oil far exceeds the energy or btu required by the system to recover the oil and more specifically that the ratio of the recovered energy to the expended energy is in a very favorable range;
d) a system or method which is able to substantially recover all the oil in a subterranean oil formation;
e) a system or method which is able to recover oil from an entire field with one heat application;
f) a system whose efficiency is increased by water agitation;
g) a system and/or method which can operate with fuel fired burners;
h) a thermal system and/or method of oil recovery whose efficiency is enhanced by the addition of chemicals to the water; and
i) a system and/or method which can be readily applied to shallow or deep wells.

In accordance with yet another object of the invention, an improved radiant tube burner is provided.

In accordance with another object of the invention, an improved radiant tube burner is provided which can be used in long lengths as a small diameter cylindrical down hole burner.

In accordance with still another object of the invention, a fuel fired radiant tube burner is provided which maintains a relatively uniform radiation heat flux over its length.

In accordance with still another object of the invention, a fuel fired radiant heat tube is provided which maintains an even temperature distribution about its length at high elevated temperatures in excess of 2,000° F.

In accordance with still another object of the invention, a fuel fired radiant tube burner is provided which generates uniform heat fluxes over a very wide operating range and over very large heat exchange areas.

In accordance with still yet another feature of the invention, a fuel fired radiant tube burner is provided which can generate heat fluxes in excess of 25,000 but/hr-ft$^2$.

These and other objects of the present invention will become apparent to those skilled in the art upon a reading of the detailed description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF THE PREFERRED EMBODIMENT

THE SYSTEM

Figure 1:
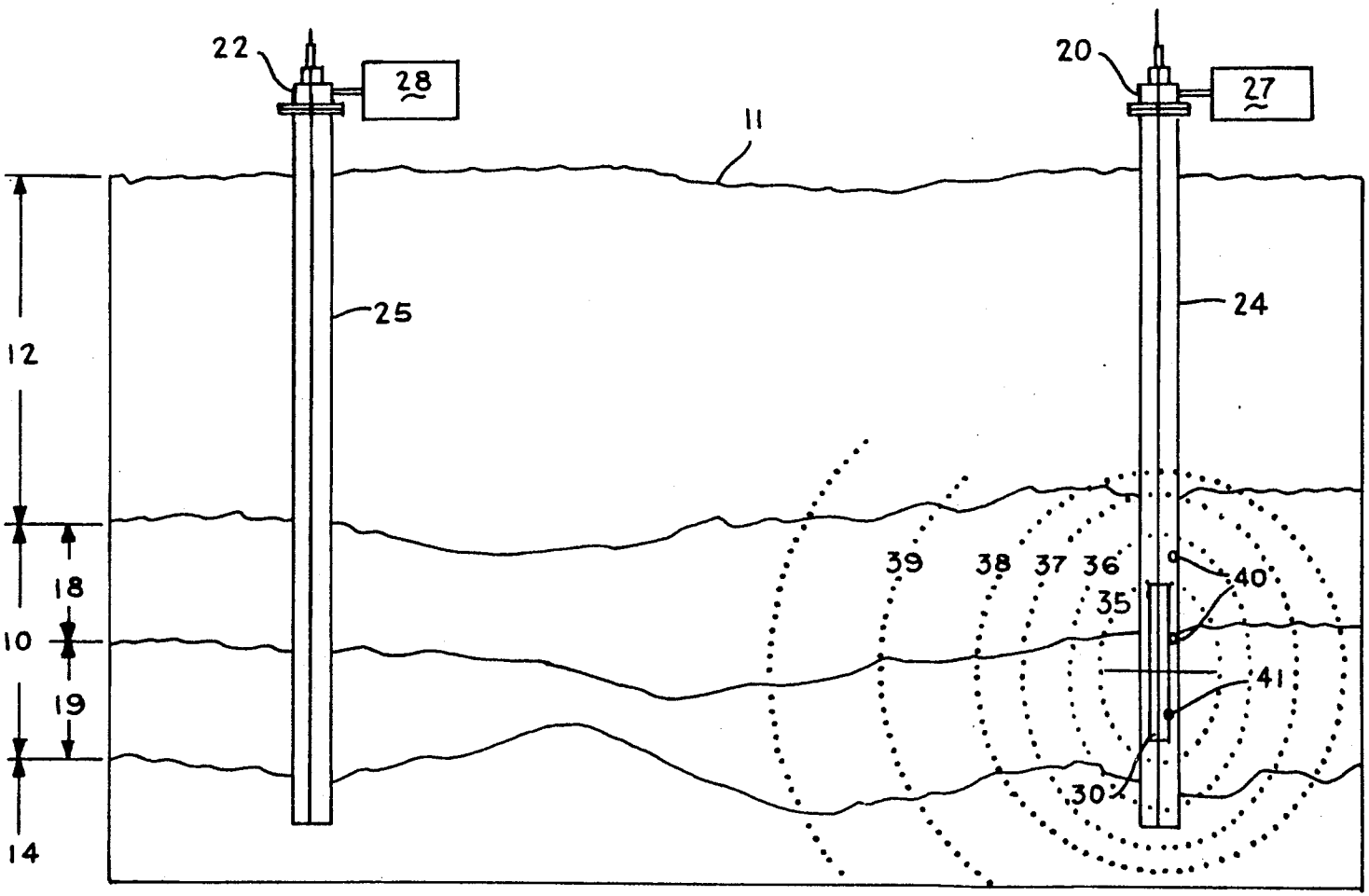
FIG. 1 is a schematic elevation view of an oil reservoir formation.

Referring now to the drawings wherein the showings are for the purpose of illustrating a preferred embodiment of the present invention only and not for the purpose of limiting the same, there is shown in FIG. 1 a schematic elevational view of a subterranean oil reservoir formation indicated by the dimensional arrows 10. Reservoir formation 10 is sandwiched between soil or earth extending from the top of reservoir formation 10 to the surface 11 which is generally referred to as overburden and indicated by the dimensional arrows 12. Similarly, the earth extending below reservoir formation 10 is defined as underburden and is generally indicated by dimensional arrows 14.

As used herein and in the claims, the term "reservoir formation" means, in the broad sense, any subterranean formation encased within an overburden 12 and an under-burden 14 which contains a substance that with the application of heat becomes sufficiently movable in a liquid state to enable the liquid to be removed from reservoir formation 10. With respect to the recovery of oil from reservoir formation 10, it is contemplated that reservoir formation 10 could be a tar sand formation or a shale oil formation. In the preferred embodiment, reservoir formation 10 is to be viewed as a conventional oil reservoir formation and preferably one in which steam injection and/or steam flooding has been used at the site in an attempt to recover as much oil from reservoir formation 10 which was then economically feasible. In spent wells of this type, it is conservatively estimated that at least fifty percent (50%) of the oil remains in the reservoir formation. This is schematically illustrated in FIG. 1 by arbitrarily dividing reservoir formation 10 into an upper open formation indicated by dimensional arrows 18 and a lower oil formation indicated by arrows 19. Thus, upper formation 18 is representative of a space within reservoir formation 10 which was once occupied by oil which has now been pumped from reservoir formation 10 while lower formation 19 is indicative of a space within the reservoir which can be viewed as a mass of solidified sludge containing a heavy viscous oil including oil trapped within rock formation or sand, etc.

At the site, an injection well 20 and a production well 22 is provided and production well 22 is spaced some distance away from injection well 20. Injection well 20 includes an injection bore 24 extending into reservoir formation 10 and similarly, production well 22 includes a production bore 25 extending into reservoir formation 10. Typically, the depth of bores 24, 25 penetrate through most, if not all, of reservoir formation 10. As thus far described, the system is conventional in that a current site is described where steam was injected through injection bore 24 to saturate reservoir formation 10 and in the process thereof to heat the oil in reservoir formation 10, improve viscosity and thus permit more or enhance the recovery of oil through production well 22. The steam flooding or injection process is continued until it becomes economically unfeasible. That is, a barrel of oil recovered from reservoir formation 10 has a certain quantity of energy which can be expressed in terms of total btu's of heating value. When the energy required, which again can be expressed in terms of btu, to form and pump the steam into the reservoir begins to approach the btu's or energy recovered, the system becomes no longer feasible. For a recovery system to be viable, the energy expended to the energy recovered should be in the ratio of 1:4 or 1:3 or smaller. Calculations indicate that such ratios are easily achieved with the present invention.

The problem to which this invention is directed can be defined by stating that the object is to arrive at a system which directly applies the system heat to the oil formation with minimal loss. Preventing the application of heat is the fact that the only access to reservoir formation 10 is through bores 24, 25 which typically are about 8" in diameter and extend several thousand feet beneath surface 11. Thus, as explained above in the Background, steam as opposed to hot water is conventionally preferred as the medium to inject into reservoir formation 10. When the steam is injected from surface 11, it loses heat at it travels through injection bore 24. To overcome that heat loss and to improve the heat transfer effects of the system, it is known, as discussed above, to place down hole heaters in the injection bore. While this is an improvement, steam will condense within reservoir formation 10 and in the process of condensing give up sensible heat. From an economic recovery point of view, however, steam flooding and injection processes are limited by the formation of fingers or channels in oil formation 19 produced during the first injections of steam into reservoir formation 10. As discussed at some length in the Background, the channels or fingers which are formed provide paths of least resistance and steam in the second and third injection attempts simply flow into these channels and condense to water. However, since the oil has already been exhausted from the fingers, further oil recovery is no longer feasible.

In accordance with the present invention, water is pumped down injection bore 24 until it completely fills the entire reservoir formation 10. Specifically, the water completely fills upper formation 18 and further, the reservoir is under hydrostatic pressure, i.e. the water column in bores 24, 25. The system is ideally suited for deep wells for reasons which will become apparent hereafter. At a minimum the pressure on the water must be such that the water occupies, fills or plugs the steam channels formed in prior recovery methods in lower formation 19. If the hydrostatic pressure is insufficient to accomplish this, then an external injection well pump 27 and/or a production well pump 28 is to be employed to generate sufficient pressure. Thus, as a limiting factor, the pressure of the water in reservoir formation 10 must be sufficient to plug the steam fingers and overburden 12 and underburden 14 must have sufficient density, mass, or depth to sustain the pressure. If reservoir formation 10 cannot be pressurized, the system will not work optimally. Less efficient and slower heating can still take place.

Figure 3:
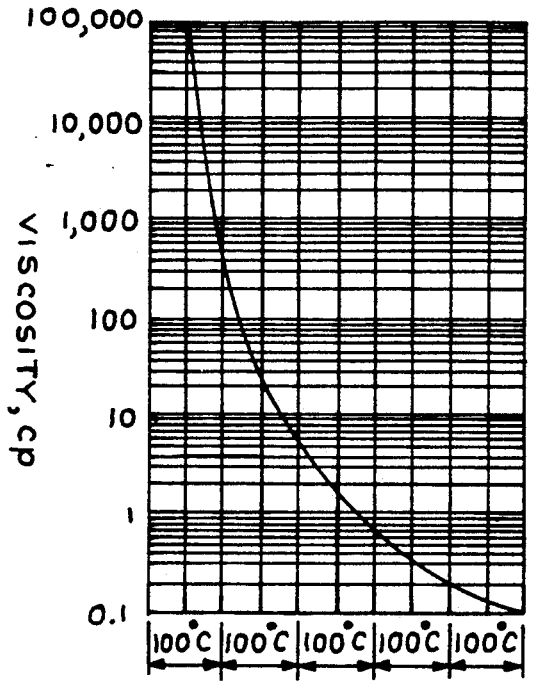
FIG. 3 is a graph of viscosity (in centipoise) versus temperature for any particular fluid.
Figure 4:
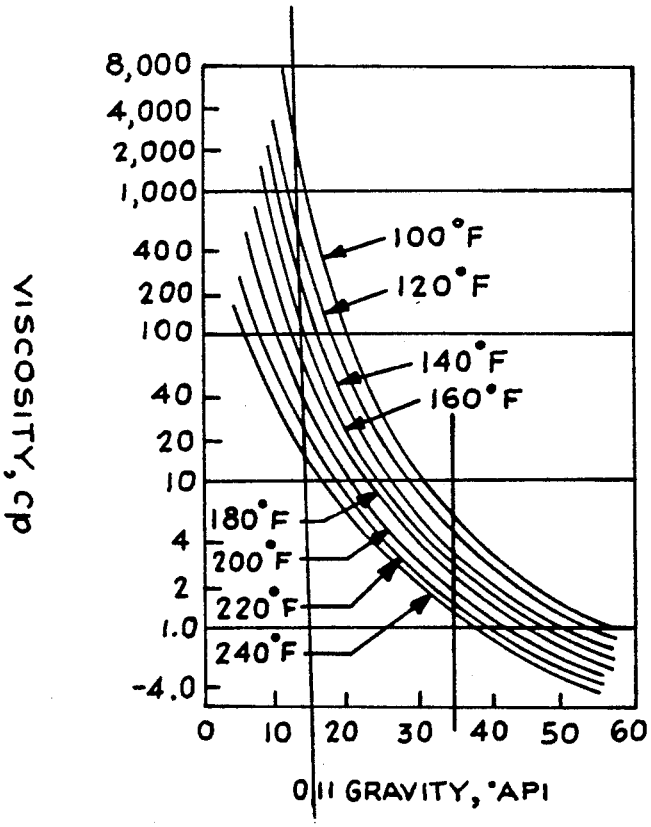
FIG. 4 is a graph showing the viscosity of gas-free crude oils at atmospheric pressure versus oil gravity expressed in API degrees.

Within injection bore 24 and at a predetermined position within reservoir formation 10 is a radiant tube on immersion heater 30. Radiant tube heater 30 may be sized slightly less than bore diameter 24 to permit the water column in injection bore 24 to remain in fluid communication with reservoir formation 10. Alternatively, reservoir formation 10 could be flooded from another well which is not used in the system. Radiant tube heater 30 is sealed from the water and simply transfers heat to the water in upper formation 18 as well as radiating heat to lower formation 19. Once reservoir formation 10 is pressurized, radiant tube heater 30 is actuated and heat is conducted into reservoir formation 10 over a period of months (and depending upon reservoir formation, size, etc., a number of months), until the entire reservoir formation 10, at least reservoir formation spanning the distance between injection well 20 and production well 22, is heated. As is well known, heating of the oil remaining inside reservoir formation 10 decreases its viscosity and improves its mobility. The effect of temperature on viscosity is very strong. In FIG. 4, taken from a reference, *Thermal Recovery Methods* by P. D. White, published Penwell Books, 1983, Tulsa, OK, a viscosity of a 35 API crude is decreased by a factor of 5 when increasing crude temperatures by as little 140° F. This same temperature increase creates a reduction in viscosity of a factor of 100 when heating a 15 API crude. Temperature, therefore, has a very pronounced affect on liquid viscosity. As shown in FIG. 3, the viscosity of any liquid is reduced by temperature and can be reduced by as much as a factor of one million (1,000,000). Thus, the charts shown in FIGS. 3 and 4 demonstrate that slight temperature increases significantly decrease viscosity and that temperature increases in the magnitude of several hundred degrees produce tremendous drops (i.e. an exponential function) in viscosity.

Temperature also has an affect on some other material properties which are useful to the system disclosed. Surface tensions of liquids decrease with temperature, thermal conductivity of liquids decrease only very moderately with temperature and thermal conductivity of saturated porous rock increases both with the amount of liquid absorbed and with temperature.

Generally speaking, the flow rate or velocity of crude oil is proportional to the pressure on the crude in the reservoir formation and inversely proportional to the absolute viscosity. The flow of oil in the formation can be reasonably described by an equation in the general form:

$$\frac{V(\text{vel.})}{A(\text{area})} = \frac{C(\text{effect. permeability})}{\text{centipoise(abs. viscosity)}} \times \frac{dp(\text{pressure change})}{dx(\text{distance change})}$$

In this equation, the effective permeability is slightly dependent on the temperature and the absolute viscosity, for reasons discussed above, is strongly dependent on the temperature Thus, one can expect that the flow velocity of the crude can be accelerated tremendously. That is, the higher one can increase the final liquid temperature the more pronounced the acceleration of fluid flow would be. The final effect of temperature can be as high as ten thousand (10,000) and close to one million (1,000,000) in a reservoir with high hydrostatic pressures which permits heating close to the critical temperature of water.

In conjunction with the discussion of viscosity decrease by temperature increase, along with the corresponding increase in fluid flow or mobility by slight differential pressure is also the fact, as clearly shown by steam tables, that as the pressure exerted on water increases, the temperature at which steam forms also increases until the critical point is reached. The critical point of steam is at 705.47° F. and 3208.2 psia or 6,080 feet of water column. Further, the behavior of steam and water is quite different above the critical point when compared to the behavior of steam below this point. The large amount of latent heat which is given off upon condensation of steam to water does not exist above the critical point. Water is converted into steam with only a minor change in specific volume and only the effect of the sensible heat can be used for heating the reservoir. Thus, the pressurization of the water within reservoir formation 10 functions not only to plug the steam fingers, increase thermal conductivity to lower formation 19, enhance movement of the crude by slight differential pressure to production well 22, but also permits reservoir formation 10 to be heated at relatively high temperatures compared to prior art processes to significantly enhance the viscosity decrease of the crude. The correlation of these factors is the underpinning of the system invention.

Thus, the temperature and pressure are relative terms in a system sense and are interdependent. That is, for any given pressure less than critical, i.e. 3,208.2 psia, the temperature at which the reservoir is heated is limited to that which will not produce steam. Once the pressure exceeds critical, i.e. the well is deeper than 6,080 feet, sudden evaporation does not occur any longer. This is the critical point temperature for steam, i.e. 705° F. Maximum temperature in the reservoir is limited by the desire to recover oil and not a gas even though if the oil was decomposed and a gas recovered (as occurs in the in situ combustion process), the gas recovered would have a heating value. The system is thus optimally suited for deep wells where the hydrostatic pressure exerted by the water exceeds the critical point for steam condensation and steam injection becomes impossible. Deep reservoirs can still be heated optionally by the proposed method with the proposed heater. The system will still function for shallow wells with only a hydrostatic head of 1,500 or so feet. In such instance, the boiling point of water is still raised and from the graphs discussed in FIGS. 3 and 4, a temperature rise of several hundred degrees will still result in a significant reduction in crude viscosity to the point where the crude and the water can freely move together so that recovery can be had. Thus, for shallow wells where only a small hydrostatic pressure is exerted on the reservoir formation, the heat must be controlled not only by that sensed in the lower formation 19 but also the temperature of the water in upper formation 18 and depending on the weight of the crude, the type of lower formation 19, etc., the time of the process may be extended and/or full recovery of the oil in reservoir formation 10 may become economically unfeasible. Accordingly, it is possible to enhance production output from shallow wells, i.e. wells from 1,500 to 5,000 feet, by externally pressurizing reservoir formation to a higher value than that which would otherwise be produced by the hydrostatic head pressure, thus increasing the boiling point of the water, further lowering the viscosity, etc. In FIG. 1, this is schematically illustrated by injection pump 27 and/or production pump 28. As noted above, should this additional step be taken, overburden 12 and also underburden 14 must have sufficient density or mass to withstand the additional pressure.

The next feature of the system is the slender, gas fired, immersion or radiant tube heater 30 which is lowered from ground level 11 into the flooded injection reservoir formation 10. The outside diameter of radiant tube heater 30 is slightly less than bore 24 so that water can pass therearound for circulation and pressure developing purposes. The length of the heater is long. Optimally, it is approximately the same length as the depth of reservoir formation 10 although heater 30 could be as little as 15 to 30 feet in length. After radiant tube heater 30 has been positioned at the formation level, it is ignited and heating of the flooded reservoir formation 10 can begin. It will be appreciated that conductive heat flux as schematically illustrated by lines 35 will penetrate formation 10 and as a function of time will develop isotherms or heat patterns schematically illustrated by dash lines 36, 37, 38 and 39. Isotherms 36–39 will propagate uniformly in all directions. As a point of reference, if radiant heat tube 30 were a point source, the isotherms or heat paths would assume a spherical configuration. While in theory, the system of the present invention can function with a point source heater, its efficiency is materially enhanced by using a cylindrical heater of long length which would generate more or less straight line portions of the heat path or isotherms such as shown at 39 which corresponds to the length of heater 30 and which has the effect of flattening the isotherms into somewhat the shape of a truncated ellipse to minimize excessive heating of overburden 12 and underburden 14. It should also be appreciated that for heater lengths of the type which are preferably used in the system of the present invention and apart from energy/cost considerations, it becomes physically difficult if not impossible to construct electric heating elements which can uniformly generate the large heat fluxes along lengths under discussion within the confines of a bore or well casing having a dimension of 8". Thus, while an electric heating arrangement could function to generate a heat pattern within the broad concept of the overall system, the efficiency and the heating time of the reservoir formation could adversely affect the economies of the recovery.

Technically, isotherms 36–39 shown in FIG. 1 are schematically correct for oil shale and tar sand formations where a separate top layer of water 18, if it exists, occupies a relatively insignificant volume of reservoir formation 10. In such applications, the water would be functioning in the system in the sense of a pressurization-fluid flow medium whereas in the spent well formation of the preferred embodiment, the water is additionally acting as a heat transfer medium. In the spent well formation shown in FIG. 1, the lower portion 19 of reservoir formation 10 will be heated not only by the lower portion of isotherms 36–39 corresponding to lower portion 19 but also by heat from the water in upper reservoir portion 18 penetrating downwardly into lower portion 19. That is, the water in upper formation 18 will heat slower than the heavier crude sludge in lower formation 19 and that heat, in turn, will likewise heat oil in lower formation 19. However, the isotherms in upper formation 18 can occur quicker than those in lower formation 19 when water begins moving. To enhance heating of lower formation 19 by the water within formation 10, it is possible to cause movement of the water from injection well 20 to production well 22 by maintaining differential pressures vis-a-vis pumps 27, 28 or it is possible to simply cycle water flow back and forth between production well 22 and injection well 20 prior to recovering the crude by simply cycling pump 27, 28.

Radiant tube heater 30 continues to heat reservoir formation 10 until the entire formation has been raised to a temperature whereat the crude and the water can freely move together. Again, this is a relative statement dependent upon the characteristics of the particular reservoir formation and the type of crude contained therein and recognizes that production well 22 may be placed in operation prior to the complete reservoir formation 10 being brought to a uniform temperature. Preferably, production does not begin until the entire formation has been elevated to a preferred temperature. During heating, the system is controlled by thermal couples 40 placed around the heater at various depths. When the temperature sensed at lower formation thermal couples 40 and 41 reaches a value whereat gas can be produced from the crude or, if hydrostatic pressure in reservoir formation 10 is less than critical when the temperature sensed by heater thermal couple 41 will produce gas or steam, the fuel fired burner in radiant tube heater 30 is turned down. Based on thermocouple data a mathematical model predicts temperatures in the formation. Once the temperature of reservoir formation 10 has been raised to a value whereat the water and crude can flow together, production well 22 is actuated in accordance with any conventional mechanisms to recover the oil. This can be done by maintaining differential pressures between production well 22 and injection well 20 so that a "natural flow" can result, or sucker rod type pumps actuated mechanically or hydraulically can be used, or hydraulic subterfuge pumps or centrifugal well pumps can be employed. If the crude is significantly heavier than the water, compressed air can be forced down the production well casing such as used in the mining of liquid sulphur and disclosed for example in Williams et al U.S. Pat. No. 4,157,847.

It is to be appreciated that the heating times to raise the reservoir formation temperature limits at which crude recovery can begin are measured in terms of months. However, the system has been inherently conceived to reduce the months to a number whereat the process is economically attractive. Heretofore, if the general concept of an in situ heating of the total reservoir formation was discussed, it was discarded simply as being economically unfeasible or physically impossible to achieve. Fundamentally, however, such an in situ system depends essentially on three parameters: i) the thermal conductivity of the medium within reservoir formation 10; ii) the maximum allowable temperature; and iii) the distance from the heater to the production well. As shown herein, by injecting water and flooding the reservoir, the conductivity has been increased to the maximum. The maximum allowable temperature close to the heater depends mainly on the characteristics of the oil. By preventing decomposition or polymerization of the oil, one will prevent gas formation and deposits. If the area around the injection well has been cleaned by another recovery technique, then only water or brine will contact the heater. The maximum heater and fluid temperature will then be governed by the highest allowable hydrostatic pressure in the formation. If these pressures can be kept at elevated levels then rather high water temperatures can be achieved and the temperature gradient within the fluid filled formation can be increased. High thermal conductivities and high temperature gradients are the two measures which will accelerate heating of the liquids. This is the basic system concept. Optimization of the system or enhanced use of the heat produced in the system occurs by making radiant heat tube 30 long to produce the preferred isotherm configuration. Further enhancement occurs by moving the water during heating. A still further enhancement of the process is possible by the addition of chemicals to the water to lower interfacial tension and displace oil or to dissolve reservoir oil. The chemicals are more fully discussed in H. K. Van Poolen's *Enhanced Oil Recovery*, and include the chemicals used in surfactant-polymer injection, caustic or alkaline flooding, miscible hydrocarbon displacement and carbon dioxide injection. The latter could be introduced from the flue gases leaving fuel fired heater 30.

Figure 2:
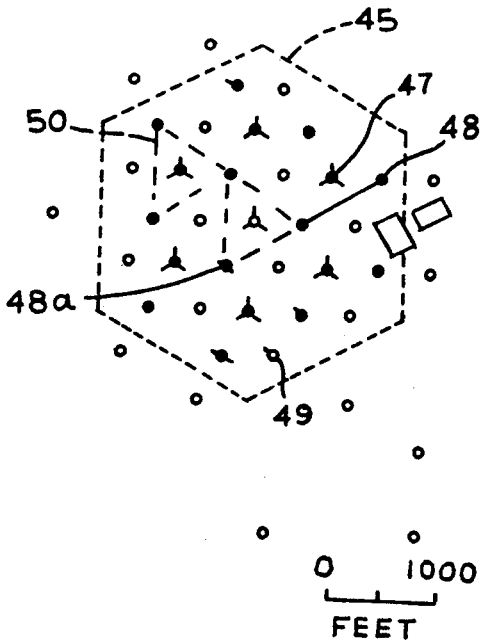
FIG. 2 is a schematic representation of an oil drilling well site.

As noted, one of the fundamental factors affecting the recovery benefits of the system is the distance between injection well 20 and production well 22. That spacing is a matter of design optimization. However, because isotherms 36–39 are uniformly propagating from injection well 20, the system is ideally suited for recovery of the oil within the entire field in one heat cycle. This is diagrammatically illustrated in FIG. 2 where a previously drilled oil field bonded by the hexagonal dotted line 45 is modified in such a way as to recover the total oil from the field. Within field 45, production wells are designated by reference numeral 47 and injection wells with radiant heater tubes 30 inserted therein are designated by reference numeral 48 while unused existing injection wells are designated by reference numeral 49. In the array disclosed in FIG. 2, each production well 48 is basically situated within a triangular area 50 bounded by radiant heater injection wells 48. In this pattern, any particular radiant injection well 48 such as **48*a* will transfer heat simultaneously to three adjacent production wells 47. It can be demonstrated from heat transfer calculations that the basic configuration defined by the placement of in situ heaters will either be triangular or rectangular (square) for optimum heat utilization purposes. As applied to this invention for optimal results, injection wells 48 will be arranged in a triangular pattern 50 as shown with the production well at the center thereof or in a rectangular pattern (not shown) with the production well centered therein so that each radiant heater injection well 48 will simultaneously heat four production wells. It is to be appreciated, then, that the economies of recovering the oil when applied on a total reservoir formation basis using the system of the present invention can be reduced by factors of $\frac{1}{3}$ (triangle) or $\frac{1}{4}$ (rectangle) over that which would otherwise occur if the system were simply applied to one injection well 20 heating one production well 22**.

As indicated above, a recovery system is viewed as economically feasible when the energy expended to the energy recovered can achieve ratios of at least 1 to 3 or 1 to 4. Calculations indicate a much more favorable return with the present system. Assuming that a deep well application exists where the water can be hydrostatically pressurized to the critical pressure, i.e. 3060 psia, in a formation containing only 40% oil context, a temperature of 500° F. will reduce the viscosity of the oil in lower formation 19 to a value whereat the oil will freely flow with the water. Calculations indicate that the formation can be heated to this temperature at an expenditure of 85 to 170 Btu/lb of formation. A barrel of oil contains approximately 6,000,000 Btu's of energy of 18,000 Btu per lb. of oil. Since the formation contains only 40% oil, each lb. of formation which must be heated contains 7,200 Btu's of energy. Thus, the ratios of heat expended to heat recovered is 85–170 Btu/lb of heat in to 7,200 Btu's per lb. of formation out or 1.2 to 2.4%. Now, as noted by the isotherms discussed in FIG. 1, the transferred heat will also heat overburden 12 and underburden 14 and it can be assumed that the heat used for heating can be 3 to 5 times the number calculated so that 7.2% to 12% of the heat content of the oil recovered is realistically expended. Thus, it can be assumed, allowing for other factors such as burner efficiency, that the system disclosed will use anywhere from 400,000 to 800,000 Btu/barrel of oil recovered. This is extremely favorable when compared to the energy expenditures of present day systems.

RADIANT TUBE HEATER

The principles of the radiant fuel fired tube heater 30 of the present invention are schematically illustrated in FIGS. 5, 6, 6*a* and 7. Radiant heater tube 30 is ideally suited for the system of the present invention because it can be constructed as a long length small cylindrical member which can fit within the diameter of an injection bore and it is designed, as explained hereafter, to generate a uniform radiant heat flux substantially along its length. Importantly, very high heat transfer values heretofore not possible in fuel fired burner arrangements are possible also permitting high temperature applications in excess of 2500° F. Thus, radiant tube heater 30 can be applied to many industrial applications other than oil recovery such as might be encountered in certain heat treat processes or in metal melting processes.

Figure 5:
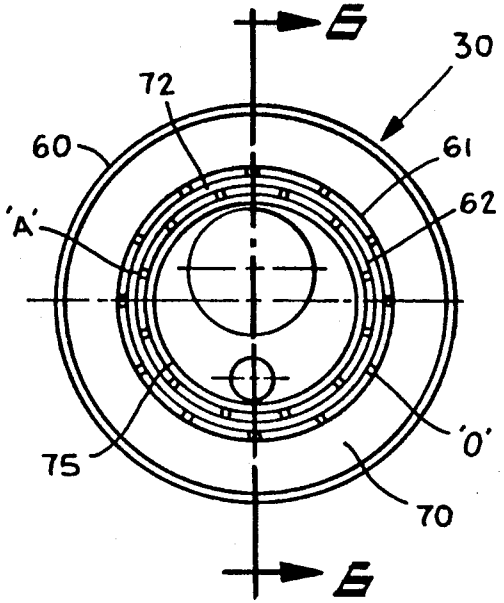
FIG. 5 is a schematic top plan view of the radiant tube burner of the present invention.
Figure 6:
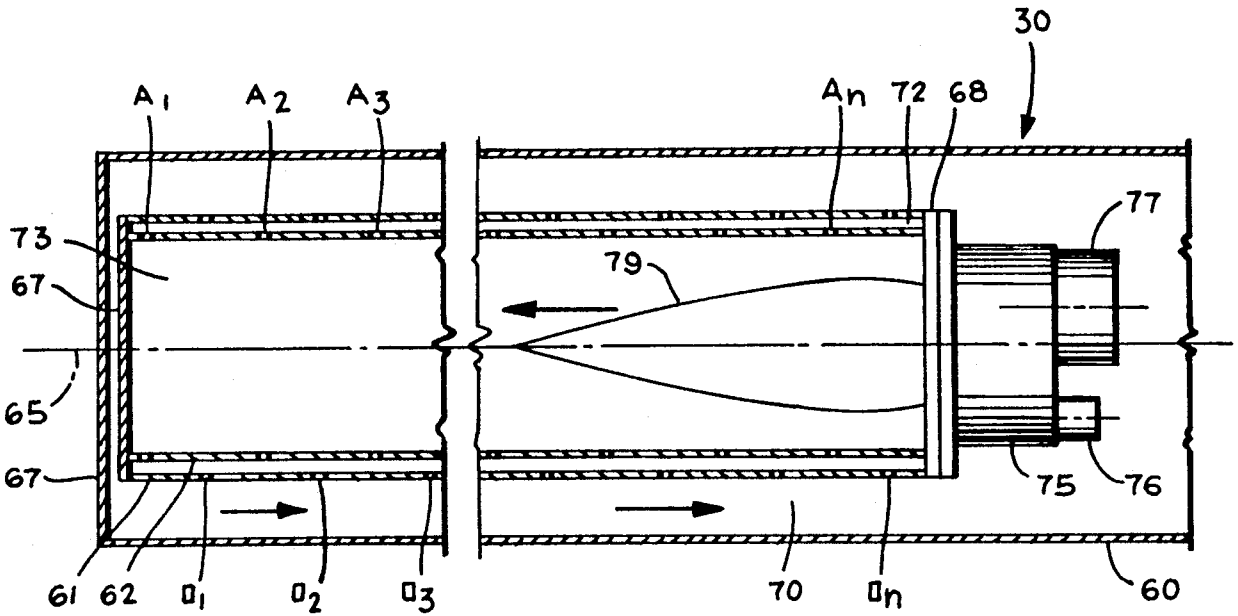
FIG. 6 is a schematic elevation view of the heater of the radiant tube heater of the present invention taken generally along line 6—6 of FIG. 5.
Figure 6A:
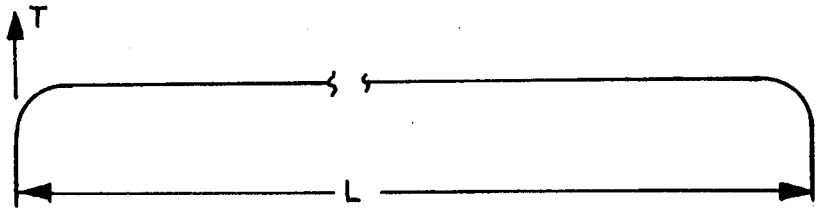
FIG. 6*a* is a graph indicative of the general heat profile generated along the length of the heater shown in FIG. 6.

As best illustrated in FIGS. 5 and 6, radiant tube heater 30 includes a cylindrical heat tube 60, a cylindrical heat transfer tube 61 concentrically disposed within heat tube 60 and a cylindrical burner tube 62 concentrically disposed within burner tube 62 and all tubes 60, 61, 62 are centered about centerline 65. An axial end plate 67 closes one axial end of all tubes 60, 61 and 62. A burner mounting plate 68 closes the opposite axial ends of heat transfer tube 61 and burner tube 62. As thus far defined, heat tube 60 and heat transfer tube 61 define a longitudinally-extending annular exhaust gas passageway 70 therebetween. Exhaust gas passageway 70 is closed at one end by end plate 67 and open at its opposite end for exhausting products of combustion. Heat transfer tube 61 and burner tube 62 define a longitudinally-extending, small annular heat transfer passageway 72 therebetween. As best shown in FIG. 6, heat transfer passageway 72 is closed at its axial ends by axial end plate 67 and burner mounting plate 68. Also, burner tube 62 is closed by axial end plate 67 and burner mounting plate 68 to define a closed cylindrical passage 73.

Mounted to burner mounting plate 68 and centered on centerline 65 is a conventional fuel fired burner 75. Any small diameter industrial fuel fired burner available from sources such as Maxon, Eclipse, North American, etc. with acceptable turndown ratios, i.e. 6:1 or 8:1, are acceptable. Burner 75 conventionally operates by mixing combustion air furnished to the burner through an air line 76 with a combustible gas furnished to the burner through a gas line 77 in a preferred combustible proportion, igniting the same and combusting the mixture to produce products of combustion schematically illustrated by flame front 79 in FIG. 6 within cylindrical passage 73. Conventional controls (not shown) are used to regulate the proportions of fuel and air, i.e. turndown ratio, to vary the heat output from burner 75. When used in the oil recovery system of the present invention, orifices (not shown) may be provided in air line 76 and gas line 77 to insure the injection of air and gas into burner 75 at the appropriate operating pressures.

Figure 7:
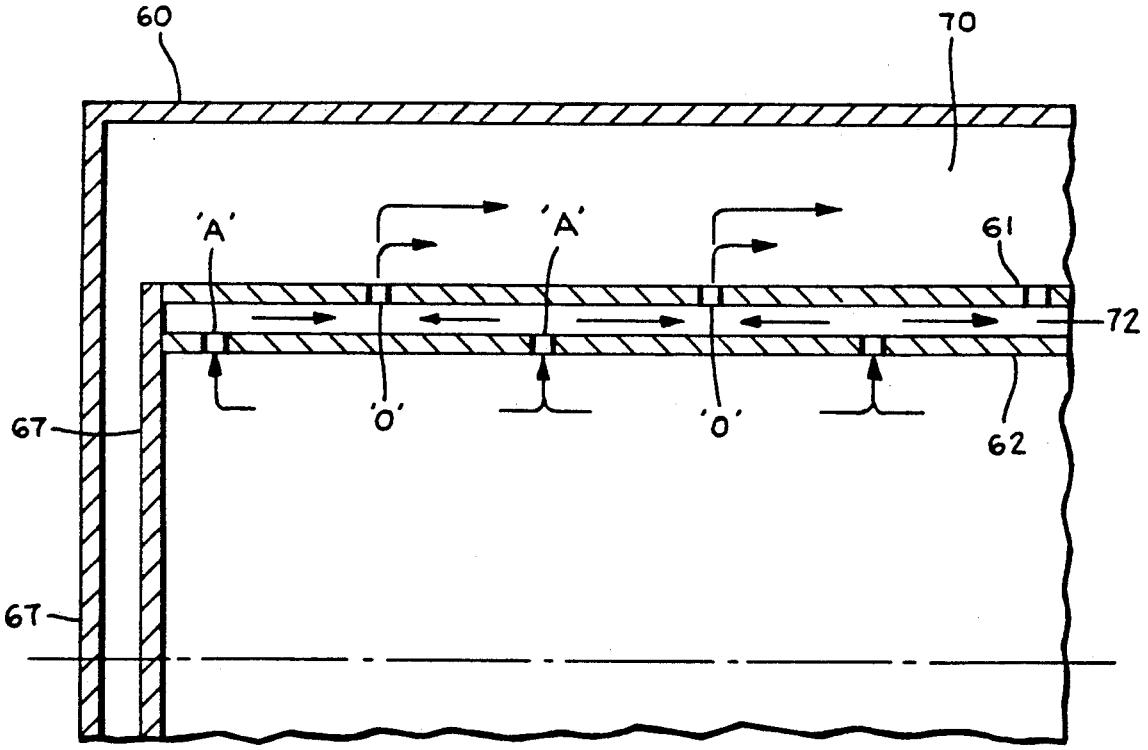
FIG. 7 is an expanded view of a portion of the heater schematically shown in FIG. 6.

Within burner tube 62, there is provided a plurality of apertures designated by the letter "A" in FIGS. 5, 6 and 7. Extending through heat transfer tube 61 there is provided a plurality of openings designated by the letter "O" in FIGS. 5, 6 and 7. The size and number of apertures "A" and openings "O" are predetermined, but for purposes of the preferred embodiment they can be viewed as circular openings of diameter equal to the thickness of the tubes through which they extend and are of constant size (although size could be varied) and of somewhat equal number so that the total number of openings "O" are the same size as and approximately equal to the same number of apertures "A". Openings "O" and apertures "A" are positioned relative to one another in a predetermined manner to define relatively long flow paths. That is, the openings "O" and apertures "A" as shown in FIG. 5 are drilled through the tubes at equally spaced circumferential increments such that an aperture is circumferentially drilled approximately midway between two adjacent openings "O" and visa-versa. In the longitudinal direction as shown in FIG. 6, apertures "A" are drilled in increasingly spaced increments (i.e. designated as $A_1$, $A_2$, $A_3$–$A_n$) from axial end plate 67 to burner plate 68. Similarly, openings "O" are longitudinally spaced to extend an increasing longitudinal distances (from $O_1$, $O_2$, $O_3$,–$O_n$) from axial end plate 67 to burner mounting plate 68. Additionally, apertures "A" are longitudinally spaced to bisect the longitudinal spacing between adjacent openings "O" and visa-versa. Generally speaking, the area within burner tube 62 comprised of apertures "A" and the area within heat transfer tube 61 comprised of openings "O" is greatest at distances furthest removed from burner 75 and the opening area progressively decreases along tube lengths in the direction of burner 75. In addition, the spacing between apertures "A" and openings "O" are offset both in a radial and longitudinal direction from one another to establish flow paths within heat transfer passageway 72 which are relatively long in length.

Conventional fuel fired industrial radiant heat tubes can be basically viewed as a burner positioned at one end of a tube and the burner fires its products of combustion into the tube at one end thereof and recovers the exhausted products of combustion from the opposite end thereof. The products of combustion heat the tube and the tube, in turn, radiates the heat to the work. While there are many variations on the concept and a multitude of burner designs which position or control the combustion process, inherently the tube will be heated intensely at the point where combustion occurs and less intensely thereafter. While the surface temperature measured at any point along the tube length for conventional radiant tube fuel fired designs may be somewhat uniform, the heat flux or the intensity of the heat generated along the length of the tube is a factor raised to the fourth power of the temperature differential and varies dramatically. Accordingly, radiant heat tube 30 will likewise generate a similar hot spot, i.e. the adiabatic temperature of the flame front, which will be transferred by radiation and convection to burner tube 72 at high values relatively close to burner 75 and which will diminish as the products of combustion from burner 75 travel towards axial end plate 67.

In accordance with the invention, because axial end plate 67 and burner plate 68 block the flow of products of combustion emanating from burner 75, the products of combustion are forced through apertures "A" into heat transfer passageway 72 and from heat transfer passageway 72 through openings 61 into exhaust passageway 70 from which the exhaust gases exit. The diametrical distance of heat transfer passageway 72 is maintained very small such that (correlated to the size and spacing of apertures "A" and openings "O") only the velocity of the products of combustion within heat transfer passageway is at a Reynolds number whereat only laminar flow exists. It can be shown that at a very close spacing between plates, a laminar flow therebetween will exhibit a higher convective heat transfer coefficient than that produced by turbulent flow.

Thus, burner 75 will heat burner tube 62 in a manner which will vary as a gradient along the length of burner tube 62. Burner tube 62 in tube will radiate the heat as a gradient to heat transfer tube 61 which in turn will similarly radiate the heat to beat tube 60. If nothing more was considered, heat tube 60 would have the same temperature gradient as burner tube 62. However, heat transfer tube 61 is also being heated, and very effectively so, by the laminar flow of the products of combustion in heat transfer passageway 72 and this flow, because of the sizing of openings "O" and apertures "A" is establishing a convective heat transfer gradient along the length of heat transfer tube 61 which is opposite to that of the temperature gradient on burner tube 62. The heat thus radiated to heat tube 60 from heat transfer tube 61 is uniform. Further, this radiated heat vis-a-vis the laminar flow convective heat transfer is boosted or additive so that the "hot spot" is uniformly transmitted along the length of the tube thus making radiant heat burner 30 ideal for high temperature or high heat transfer applications.

When used in the oil recovery system of the present invention, the diameter of heat tube 60 is slightly less than the diameter of bore casing 22 to permit water pressurization. The length of heat transfer tube 61 and burner tube 62 is sized to the desired length of the heater, i.e. 30–60 feet, and burner tube is sized to a somewhat longer length and surrounds combustion air line 76 and gas line 77 which is insulated. Heat tube 60 is then secured to appropriate casings (not shown) which allow it to be inserted into injection bore 22 a desired distance. The products of combustion exhausted from radiant tube heater 30 through exhaust gas passageway 70 can be utilized to preheat combustion air in air line 76.

An alternative and more detailed explanation of radiant heat tube 30 is as follows:

One of the most difficult performance specifications in radiant tube technology is the demand for tube surfaces with high degrees of temperature uniformities and flux uniformities. Uniformity means that radiant element temperatures are preferably better than +/− 50 F. and flux densities are, at a 2000 F. radiator temperature, better than +/− 5000 Btu/hr-sqft. This uniformity specification is so important because it will significantly impact maximum heat output from a radiant tube when operating close to the maximum allowable alloy tube temperature. It will also determine temperature uniformity of the heated load and, therefore, has product quality and productivity implications in all high temperature heating and heat treating processes.

Productivity is further impacted by the maximum heat fluxes which can be realized by radiant tube devices. Maximum heat fluxes are normally limited by either the maximum allowable alloy temperature (hot spot) which typically forms close to the burner device or by the maximum convective heat transfer fluxes which can be generated within the tube and along its entire surface. Typically, heat fluxes peak somewhere downstream but in close vicinity of the burner. At this location the flame gases are still the hottest (close to the adiabatic flame temperature) and the convective boundary layer is still thin resulting in high convective heat transfer coefficients. As the gases flow downstream inside the tube they are being cooled and the convective coefficient decreases. The effect of these variables on the heat flux is multiplicative.

Heat fluxes along the length of the radiant tube decrease rapidly. However, because the radiative fluxes on the outside of the tube decrease with the fourth power of the absolute temperature the temperature decay along the tube is normally thought to be acceptable. A decrease in temperature of 200 F. along the radiant tube is often advertised as acceptable. However, while this decrease in temperature from 2000 F. to 1800 F. represents only an eight (8) percent decrease in absolute temperature it represents a thirty (30) percent decrease in radiant heat flux. For certain manufacturing and processing operations this significant decrease in radiant flux cannot be tolerated.

Many efforts have been made to improve the heat flux distribution along such fuel fired devices and to better complete with electrically heated resistance elements. The much lower energy costs of fuel firing make fuel fired devices economically attractive. It is also easier to transport large amounts of energy in the form of natural gas rather than in the form of electricity at lower line voltages.

The device illustrated herein has been developed to create very uniform flux distributions along long and slender tubes as they are being used in many low temperature applications where very uniform fluxes are required as for instance in drying of paint, annealing of glass and aluminum, heating of temperature sensitive liquids, and in heating of underground petroleum bearing formations and reservoirs. By reversing the flow direction of the flue gases from the outside to the inside of two concentric tubes this invention can also be utilized to heat the walls of melting pots with very high heat fluxes. These high heat fluxes are essential in melting of metals like aluminum, brass, copper, grey iron, and steel because metal oxidation can be kept to a minimum and productivity and turn-around time can be improved. Fuel fired heaters of such design can suddenly compete with electric designs which use high heat flux resistance heating elements or which use high heat flux induction heating approaches.

The invention consists of three axisymmetric, parallel tubes which are spaced from each other in distance which are of vital importance for the performance of the developed device. Combusted flame products are discharged by one of the conventional burner devices into the innermost tube which has the burner on one of its ends and which is closed on its other end. The spacing between the innermost and intermediate tube is kept very close for reasons which will be further explained in detail. Both these tubes have holes or apertures which are relatively small, are of similar size, and are spaced such that they form a pattern which creates long distances between the holes on the inner tube and those on the intermediate tube.

The hot flue gases enter the holes of the inner tube and seek their way to the distantly placed holes of the intermediary tube where they exit into the annulus which is formed between the outermost tube and the intermediate tube. The space between the outer and the intermediate tube is typically much larger than the space between the inner and the intermediate tube. A factor of 8 to 16 is characteristic for tubes of intermediate length of 30 feet.

The flue gases are partially cooled after they leave the intermediate tube but they need to be transported to the exhaust end of the radiant tube apparatus which is on the same side as the burner end. While the gases are being transported back to the exhaust they are convectively heating the outer and the intermediate tube. Based on the longitudinal and radial tube dimensions and based on performance parameters the hole spacing in the inner and intermediary tube will be graduated to counteract these secondary influences which prevent perfect flux uniformity from being obtained.

By properly sizing and spacing these holes it becomes possible to obtain rather uniform heat fluxes along the radiant tube device. For instance when designing a tube with a heat flux requirement of 6000 Btu/hr-sqft and with a total net heat output of 240,000 Btu/hr over 20 feet of length one has to provide for a burner of about 500,000 Btu/hr. This burner will exhaust about 6000 SCFH which in turn must pass through the holes in both the inner and the intermediary tube. With a radiation area of 40 square feet the diameter of the outer tube is about 8 inches and the intermediary tube diameter is about 6 inches. The complete exhaust gas flow must be divided uniformly over the entire area which results in 6000 scfh/30 sqft or 200 SCFH/sqft. For a hole velocity of 1000 SFPM this results in a hole area of 200/(60*1000)=0.00333 sft/sqft or 0.48 sqin/sqft. With a ⅛ inch hole diameter one has to arrange 40 holes per square foot of radiating area. This in turn means that there is one hole for every 144/40–3.6 square inches or one hole for every square with a side length of 1.9 inches.

Obviously, the spacing of the holes can be varied. But it becomes impractical making the holes too small. One also does not want to space the holes too far apart because one will create larger pressure drops without attendant increase in heat transfer. For the narrow spacing between the inner and the intermediate tube of about ⅛ inch, the Reynolds number is about Re-0.01 ft*100 ft/s/(0.3 sqft/s)=3.3. At these Reynolds numbers the flow of flue gases is entirely laminar. Accordingly, one can arrive at the heat convective transfer coefficient from an equation like $N_u$=constant=4. The heat transfer coefficient can then be computed for a 2000° F. hot flue gas as $h_c$=4*k/d=4*0.047/0.01=18.8 Btu/hr-sqft-°F. This coefficient is approximately 3 to 5 times higher than the comparable one which one can establish in parallel flow configurations. The developed flow pattern provides above all a high flux uniformity combined with very high eat fluxes. For a typical adiabatic flame temperature of 3250° F. and with the laminar convective heat transfer coefficient of 1808 Btu/hr-sqft-°F. one can accomplish heat fluxes in the order of 25,000 Btu/hr-sqft. This heat flux is larger by a factor of 3 to 6 when compared to the heat fluxes one can typically maintain in other flow arrangements which are based on parallel flow in an annulus. This arrangement furthermore produces a very high degree of temperature uniformity and is, therefore superior to previous designs. Most importantly, this design permits one to independently vary heat flux density and heat exchanger temperature.

To be successful in heating of underground formations one has to insure that the outer heater temperature does not exceed safe operating temperatures at which the petroleum products would begin to decompose and form coke or other deposits. This temperature depends on the specific composition in each reservoir. Irrespectively, one wants, however, also to establish a sufficiently high heat flux. The developed design allows one to design a long and slender heater surface which is fuel fired and which can be be designed for a particular heat flux without resorting to large overtemperatures. Especially with the high heat fluxes which can be accomplished on the liquid side temperatures and temperature differentials can be tightly controlled. With the developed design it is entirely feasible to build fuel fired down hole heaters which are capable of generating uniform heat fluxes over a very wide operating range and over large heat exchange areas.

The same basic heat transfer configuration can also be applied for very high heat flux applications as they are preferable in melting of metals. In these applications heat fluxes in excess of 25,000 Btu/hr-sqft can be generated which are well in excess of many electric resistance heaters.

The developed heat transfer arrangement has, therefore, many applications where it can contribute to energy savings, product quality improvement and to productivity increases in many thermal heating, melting and heat treatment processes.

The invention has been described with reference to preferred and alternative embodiments. It is apparent that many modifications and alterations may be incorporated into the system, process and apparatus disclosed without departing from the spirit or the essence of the invention. For example, it should be clear that as applied to shale oil deposits where an upper water deposit may not exist within the shale formation, an in situ heat application of the type disclosed in and of itself, will be sufficient to mobilize the oil or kerogen within the shale and differential pressure which need not be water and which could be gravity or the heated flue products from the fuel fired burner could be injected into the shale formation to move the mobile heated water to a production well. It is my intention to include all such modifications and alterations insofar as they come within the scope of the present invention.

It is thus the essence of my invention to provide an in situ oil recovery system which is made possible by unique thermal recovery techniques including a fuel fired radiant tube heater.

Having thus defined my invention, I claim:

1. An in situ method for recovering oil from a reservoir formation comprising the steps of:

i) providing a conventional production well bore extending into said reservoir formation for extracting oil therefrom;

ii) providing a conventional injection well bore extending into said reservoir formation;

iii) filling said reservoir formation with water such that the pressure of said water, static or otherwise, pressurizes said reservoir formation at a predetermined pressure;

iv) providing a heater of the type which radiates heat along its length, said heater having a predetermined length and inserting said heater into said injection bore to a position whereat said heater is adjacent said reservoir formation;

v) heating said reservoir formation including said water from heat generated along the entire length of said heater within said reservoir to a predetermined temperature whereat said water and said oil within said formation will not produce vaporized gases;

vi) controlling said heat produced in said heating step so that the vaporized gases are not produced and the viscosity of said oil contained between said injection and production well bores in said reservoir formation is reduced to a viscosity such that said oil may be caused to move fluidly together with said heated water; and vii) recovering said oil from said production well bore.

2. The method of claim 1 wherein said pressure is at least equal to the critical point of steam and the heat output from said burner is controlled to a temperature whereat that position of said reservoir formation which does not contain water is heated to a temperature which does not exceed that temperature whereat said oil decomposes.

3. The method of claim 1 wherein said reservoir formation is heated without controlling the heat as required in step (vi) while continuing said heating until the oil viscosity is reduced to a viscosity whereat said oil moves fluidly with said water when the pressure of said water in said reservoir is in excess of 3208.2 psia.

4. The method of claim 1 wherein said heater tube includes a fuel fired burner within a long cylindrical tube, said heater producing radiant heat uniformly about the outside diameter of said tube throughout its length to produce a high btu input to said reservoir.

5. The method of claim 1 wherein said temperature of said water in said reservoir is monitored at various locations in said injection bore and in said production bore and the heat flux generated by said heater is regulated at a value which is slightly less than that value which would generate steam in said water in said formation at said predetermined pressure.

6. The method of claim 4 wherein said heater tube has a length of at least 30 feet and the heat flux from said heater is transferred substantially uniformly from said tube along its length, said heater producing its heat from a fuel fired burner within said heater tube.

7. The method of claim 1 wherein said heater heats said reservoir with a controlled heat flux.

8. The method of claim 1 further including the step of adding to said water a surfactant and/or a polymer mobility buffer.

9. The method of claim 1 further including the step of continuing said heating until said formation adjacent said production bore has been heated from said injection bore heater to a temperature whereat the viscosity of said oil in said formation at said production bore has been sufficiently reduced to allow flow toward said production bore by creating a differential pressure between said injection bore and said production bore.

10. The method of claim 1 wherein a plurality of injection bores spaced from and generally circumscribing said production bore are provided and a heater is positioned in each injection bore.

11. The method of claim 1 wherein a portion of said oil in said formation has previously been recovered by steam recovery processes, said steam recovery processes producing steam channels in said formation and said water having been injected to a pressure which fills said channels.

12. The method of claim 1 wherein the conductivity of heat from said injection well to said production well is enhanced by causing movement of liquid in said reservoir formation from said injection well to said production well.

13. The method of claim 12 wherein said movement is caused by effecting a differential pressure between said injection well and said production well after an initial heating period.

14. The method of claim 13 wherein the direction of said movement of said liquid is cycled between said injection well and said production well.

15. The method of claim 1 wherein said reservoir formation includes tar sand formations and oil shale formations.

16. The method of claim 1 further including the step of positively pressurizing said formation to said predetermined pressure by pumps at said injection well bore and said production well bore.

* * * * *